US008267395B2

(12) United States Patent
Yang

(10) Patent No.: US 8,267,395 B2
(45) Date of Patent: Sep. 18, 2012

(54) PAPER SUPPLY UNIT

(75) Inventor: Myung Woo Yang, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 547 days.

(21) Appl. No.: 12/511,649

(22) Filed: Jul. 29, 2009

(65) Prior Publication Data

US 2010/0092227 A1 Apr. 15, 2010

(30) Foreign Application Priority Data

Oct. 14, 2008 (KR) ..... 10-2008-0100410

(51) Int. Cl.
*B65H 1/26* (2006.01)

(52) U.S. Cl. ..... 271/157; 414/795.8

(58) Field of Classification Search ..... 271/157; 221/11; 414/795.8

See application file for complete search history.

(56) References Cited

U.S. PATENT DOCUMENTS 5,085,421 A * 2/1992 Sellers ..... 271/155
5,971,387 A * 10/1999 Kita ..... 271/9.03

FOREIGN PATENT DOCUMENTS

JP 2005-200129 7/2005

OTHER PUBLICATIONS

English langauge abstract of JP 2005-200129, published Jul. 28, 2005.
Machine English langauge translation of JP 2005-200129, published Jul. 28, 2005.

* cited by examiner

*Primary Examiner* — David H Bollinger
(74) *Attorney, Agent, or Firm* — Staas & Halsey LLP

(57) ABSTRACT

Disclosed is a paper supply unit having an improved paper supply structure. The paper supply unit includes a main body having an opening, a cassette configured to be attached to and detached from the main body through the opening. The cassette can include a first holding portion and a second holding portion, each configured to hold printing medium. The second holding portion configured to transfer printing medium from the second holding portion to the first holding portion. The paper supply unit can include a guide device disposed between the first holding portion and the second holding portion when the cassette is mounted in the main body and configured to guide the printing medium in the first holding portion.

20 Claims, 13 Drawing Sheets

PAPER SUPPLY UNIT

CROSS-REFERENCE TO RELATED APPLICATION

This application claims the benefit of Korean Patent Application No. 2008-0100410, filed on Oct. 14, 2008, in the Korean Intellectual Property Office, the disclosure of which is incorporated herein by reference in its entirety.

TECHNICAL FIELD

The present disclosure relates to a paper supply unit, and more particularly to a paper supply unit having an improved paper supply structure.

BACKGROUND OF RELATED ART

An image forming apparatus is an apparatus that is used to form an image on a paper or other printing medium according to one or more input signals. Examples of image forming apparatuses include printers, copiers, fax machines, and multi-functional peripheral devices that combine the functions of one or more of such apparatuses.

An example of an image forming apparatus is an electrophotographic image forming apparatus. In an electro-photographic image forming apparatus, an electrostatic latent image is formed on a surface of a photoreceptor by irradiating light on the surface of the photoreceptor that has been charged with a predetermined electric potential. A visible image can be formed by using a developing device that supplies a developer to the electrostatic latent image. The visible image formed on the photoreceptor can be directly transferred to, for example, a paper supplied by a paper supply unit through a transfer unit. The image transferred to the paper can be fixed on the paper by a fusing process. High capacity paper supply units have been developed and produced that include a first holding portion and a second holding portion such that papers in the second holding portion are fed to the first holding portion when the first holding portion is empty, such as when the papers loaded in the first holding portion have been depleted.

SUMMARY OF THE DISCLOSURE

In accordance with one aspect, the present disclosure provides a supply unit that may include a main body, a cassette, and a guide device. The main body can have an opening and the cassette can be configured to be removably disposed in the main body through the opening. The cassette can include a first holding portion and a second holding portion each configured to hold printing medium. The cassette may be configured to transfer printing medium from the second holding portion to the first holding portion. The guide device can be disposed between the first holding portion and the second holding portion of the cassette when the cassette is mounted in the main body. The guide device may be configured to guide the printing medium held in the first holding portion.

The guide device can be configured to guide an end of the printing medium in an upper portion of a stack of printing medium loaded in the first holding portion.

The guide device can include a guide holder coupled to the main body and a guide connected to the guide holder.

The guide of the guide device can include a first guide portion positioned opposite to a pickup roller disposed in the main body. The first guide portion can be configured to support an end of the printing medium in an upper portion of a stack of printing medium loaded in the first holding portion when the cassette is mounted in the main body.

The guide of the guide device can include a second guide portion configured to extend from a lower portion of the first guide portion. The second guide portion can have an inclined surface such that a lower portion of the inclined surface is further away from the pickup roller than an upper portion of the inclined surface.

The guide of the guide device can include a third guide portion configured to extend from a side of the first guide portion in a direction of the opening of the main body. The third guide portion can be inclined away from the pickup roller.

The guide of the guide device can be rotatably connected to the guide holder.

The rotation of the guide of the guide device may be in a direction away from a pickup roller disposed in the main body can be restricted.

The guide device can include an elastic member configured to elastically bias the guide of the guide device.

The guide of the guide device can be vertically slidably connected to the guide holder.

The guide of the guide device can include an interference portion, and can be configured to slide vertically when contact occurs between the interference portion and the printing medium fed from the second holding portion to the first holding portion.

The guide device can include an elastic member to elastically bias the guide of the guide device downward.

The supply unit can further include a vertical feed device configured to raise and lower the printing medium in the first holding portion, wherein the guide device can be configured to guide the printing medium raised by the vertical feed device.

The guide device can be a first guide device, the paper supply unit can further comprise a second guide device coupled to the main body and disposed between the first holding portion and the second holding portion.

In accordance with another aspect, the present disclosure provides a printing medium supply unit usable in an image forming apparatus for holding a supply of printing media. The printing medium supply unit may include a printing media holder and a guide device. The printing media holder may include a first holding portion and a second holding portion each configured to hold thereon printing medium. The printing media holder may be configured to transfer printing medium from the second holding portion to the first holding portion. The guide device may be disposed between the first holding portion and the second holding portion of the printing media holder. The guide device may include a movable guide member that is configured to move in a first direction to align printing medium held in the first holding portion, and to move in a second opposite the first direction to allow printing medium to be transferred from the second holding portion to the first holding portion.

In accordance with yet another aspect, the present disclosure provides and image forming apparatus that may include a printing unit, printing media cassette detachably mounted in the image forming apparatus, a pickup roller and a guide device. The printing unit may be configured to form a visible image on a printing medium. The printing media cassette may include a first holding portion and a second holding portion each configured to hold thereon one or more printing media. The printing media cassette may be configured to transfer a replenish supply of printing media from the second holding portion to the first holding portion. The pickup roller may be disposed proximate to the first holding portion, and may be, configured to pickup the printing medium from one or more printing media held in the first holding portion, and to convey the picked up printing medium to the printing unit. The guide device may be disposed between the first holding portion and the second holding portion of the printing media holder. The guide device may include a movable guide member that is configured to move in a first direction to align one or more printing media held in the first holding portion. The movable guide member may be configured to move in a second opposite the first direction to allow the replenish supply of printing media to be transferred from the second holding portion to the first holding portion.

BRIEF DESCRIPTION OF THE DRAWINGS

Various aspects and advantages of the disclosure will become apparent and more readily appreciated from the following description of the embodiments, taken in conjunction with the accompanying drawings, in which.

DETAILED DESCRIPTION OF SEVERAL EMBODIMENTS

Figure 1:
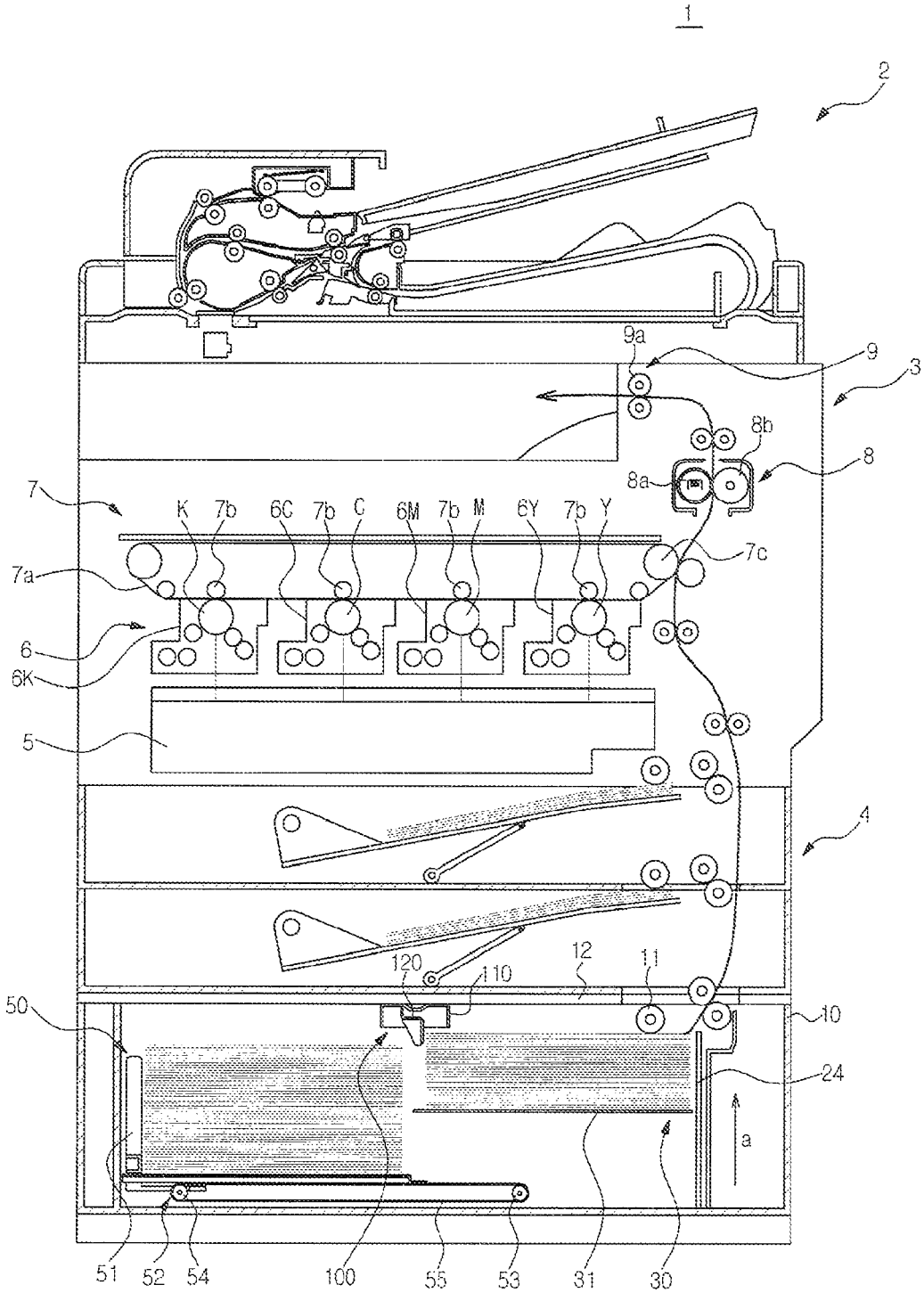
FIG. 1 is a sectional view illustrating an image forming apparatus in accordance with an embodiment of the present disclosure.

Reference will now be made in detail to various embodiments of the present disclosure, examples of which are illustrated in the accompanying drawings, wherein like reference numerals refer to like elements throughout. The embodiments are described below to explain the present disclosure by referring to the drawings.

FIG. 1 is a sectional view illustrating an image forming apparatus in accordance with an embodiment of the present disclosure.

As shown in FIG. 1, an image forming apparatus 1 can include an image scanning unit 2 configured to scan an image from an original document, and a printing device 3 configured to print the image on a printing medium such as paper, for example.

The printing device 3 can print the image according to a signal or signals received from the image scanning unit 2 or a signal or signals received from an external device, such as a personal computer (PC), for example. The printing device 3 can include a light scanning unit 5, a developing unit 6, a transfer unit 7, a fusing unit 8, and a paper discharging unit 9.

The light scanning unit 5 can be configured to irradiate light having information associated with image data on one or more photoreceptors K, C, M, and Y to form latent images on the surface of the photoreceptors.

The developing unit 6 can be configured to supply developers to the latent images formed on the surfaces of the photoreceptors K, C, M, and Y to form or produce visible images. The developing unit 6 may include four developing devices 6K, 6C, 6M, and 6Y. Each of the developing devices can accommodate a developer for a different color. For example, developing device K has black (K) developer, developing device C has cyan (C) developer, developer device M has magenta (M) developer, and developing device Y has yellow (Y) developer.

The transfer unit 7 can include a transfer belt 7*a*, multiple first transfer rollers 7*b*, and a second transfer roller 7*c*. The visible images formed on the photoreceptors K, C, M, and Y are transferred to the transfer belt 7*a* by using the first transfer rollers 7*b*. The image on the transfer belt 7*a* is transferred to, for example, a paper, which is supplied by the paper supply unit 4 and that passes through a gap between the second transfer roller 7*c* and the transfer belt 7*a*.

After passing through the transfer unit 7, the paper with the transferred image can enter the fusing unit 8. The fusing unit 8 can include a heating roller 8*a* and a pressing roller 8*b*. In the fusing unit 8, the paper having the transferred image passes through a gap between the heating roller 8*a* and the pressing roller 8*b* to fix the image to the paper by applying, for example, heat and pressure.

After passing through the fusing unit 8, the paper with the fixed image can be guided to the paper discharging unit 9. The paper with the fixed image can be discharged to the outside of a main body 10 of the printing device 3 by a paper discharging roller 9*a* of the paper discharging unit 9.

The paper supply unit 4 can include, for example, a cassette 20 (see FIG. 2) that can be used as a high capacity feeder (HCF). The cassette 20 will be described in more detail below.

Figure 2:
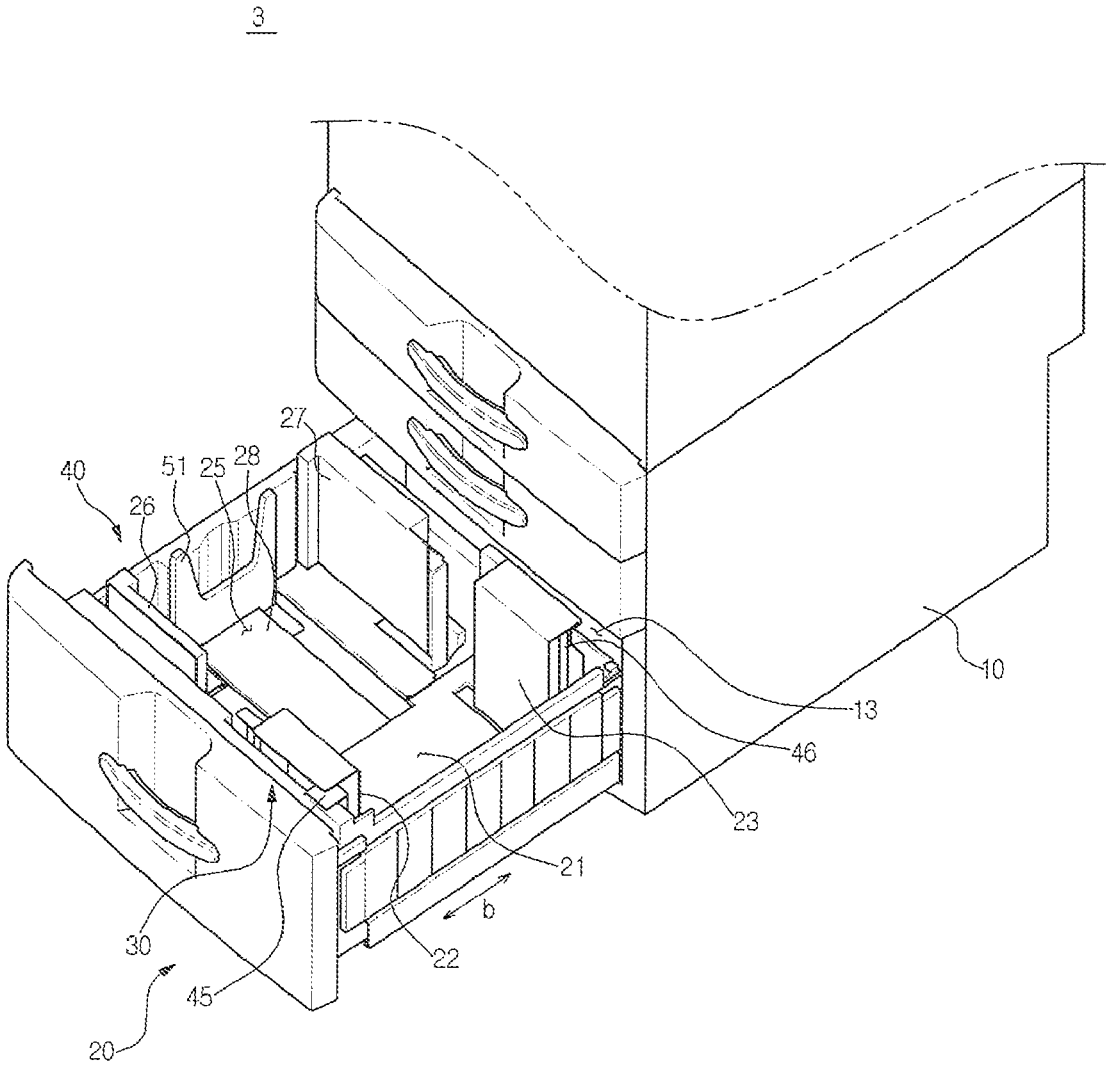
FIG. 2 is a perspective view illustrating a paper supply unit in accordance with an embodiment of the present disclosure.
Figure 3:
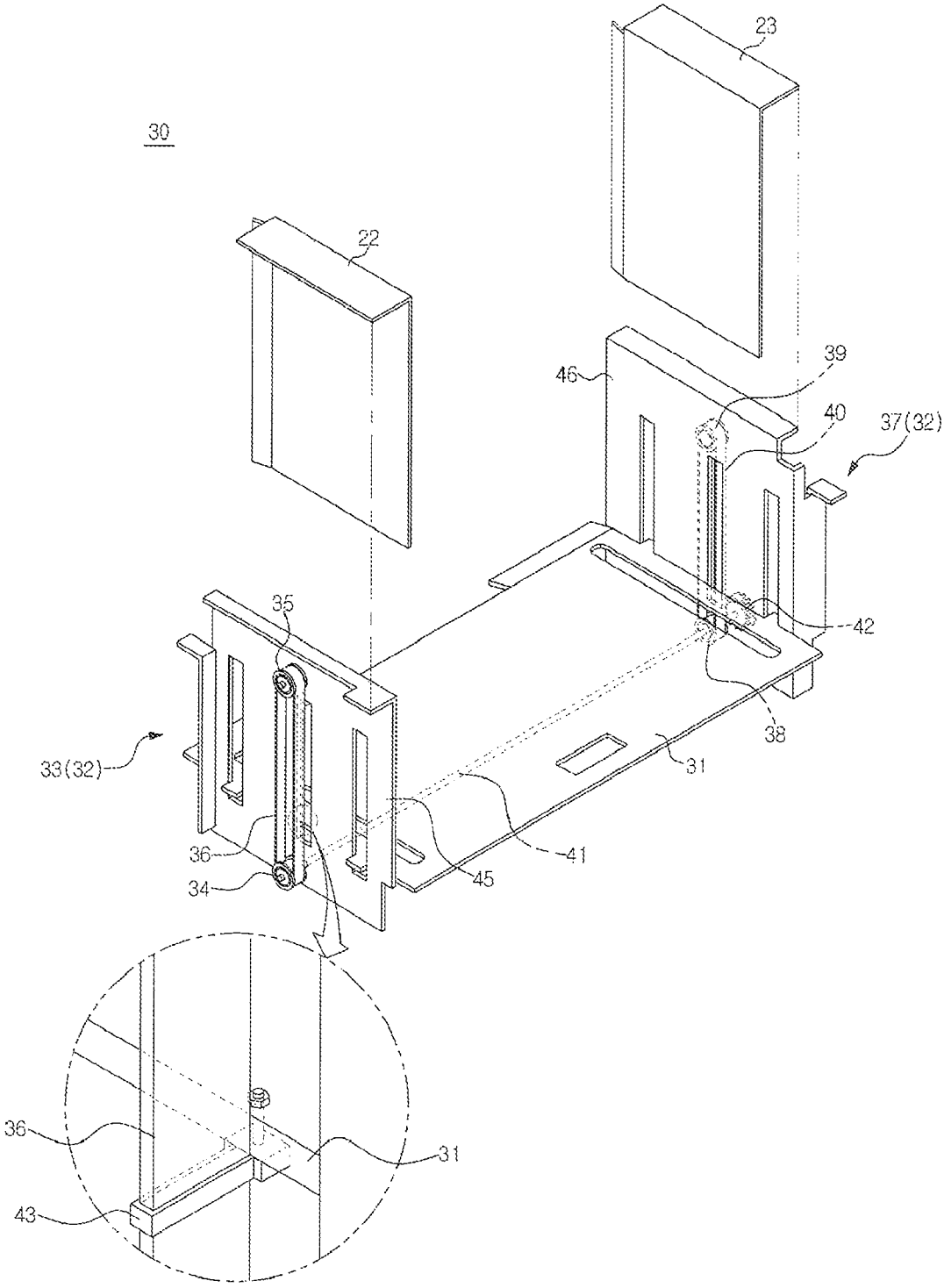
FIG. 3 is a perspective view illustrating a vertical feed device in accordance with an embodiment of the present disclosure.
Figure 4:
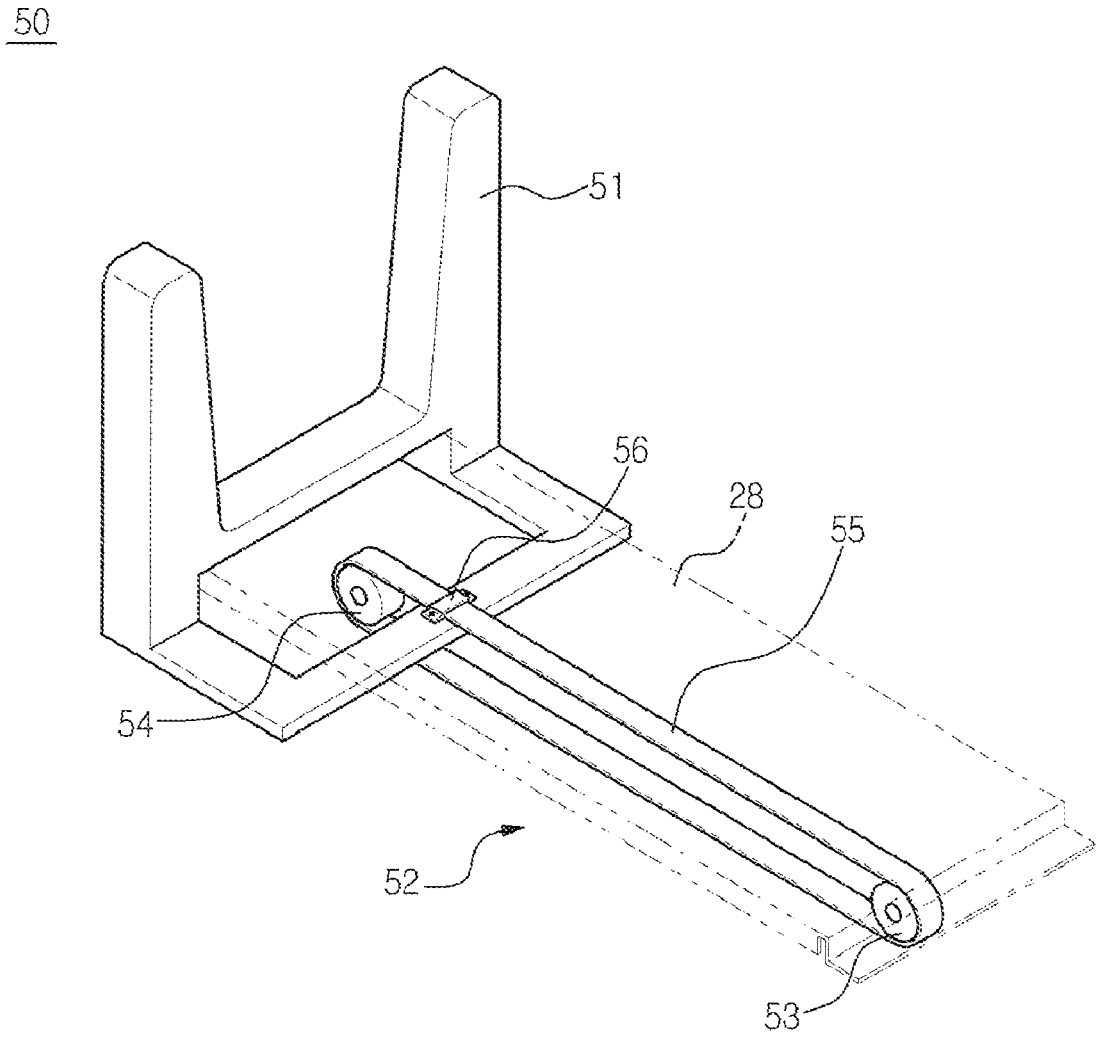
FIG. 4 is a perspective view illustrating a horizontal feed device in accordance with an embodiment of the present disclosure.
Figure 5A:
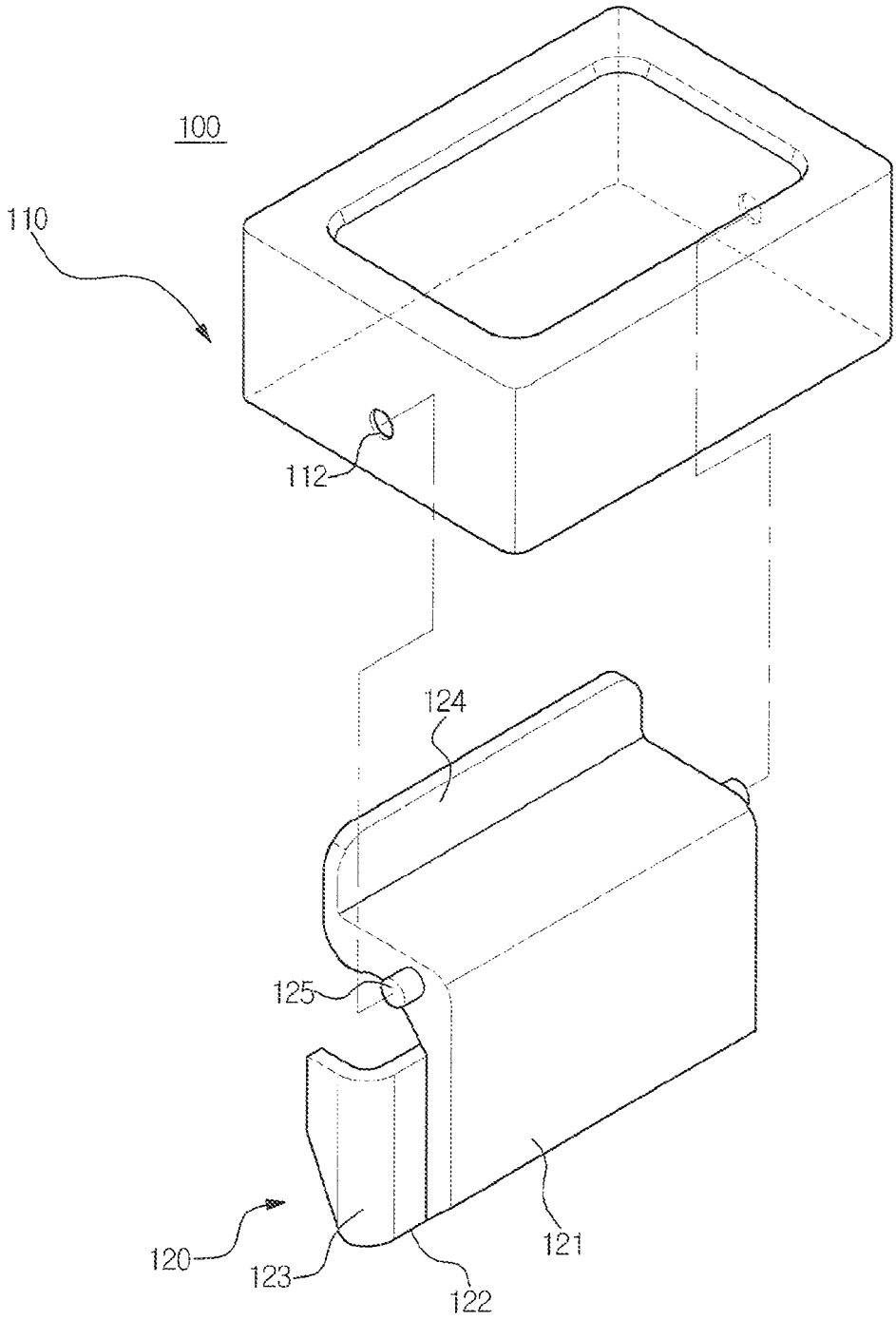
FIGS. 5A and 5B are views illustrating a guide device in accordance with an embodiment of the present disclosure.
Figure 5B:
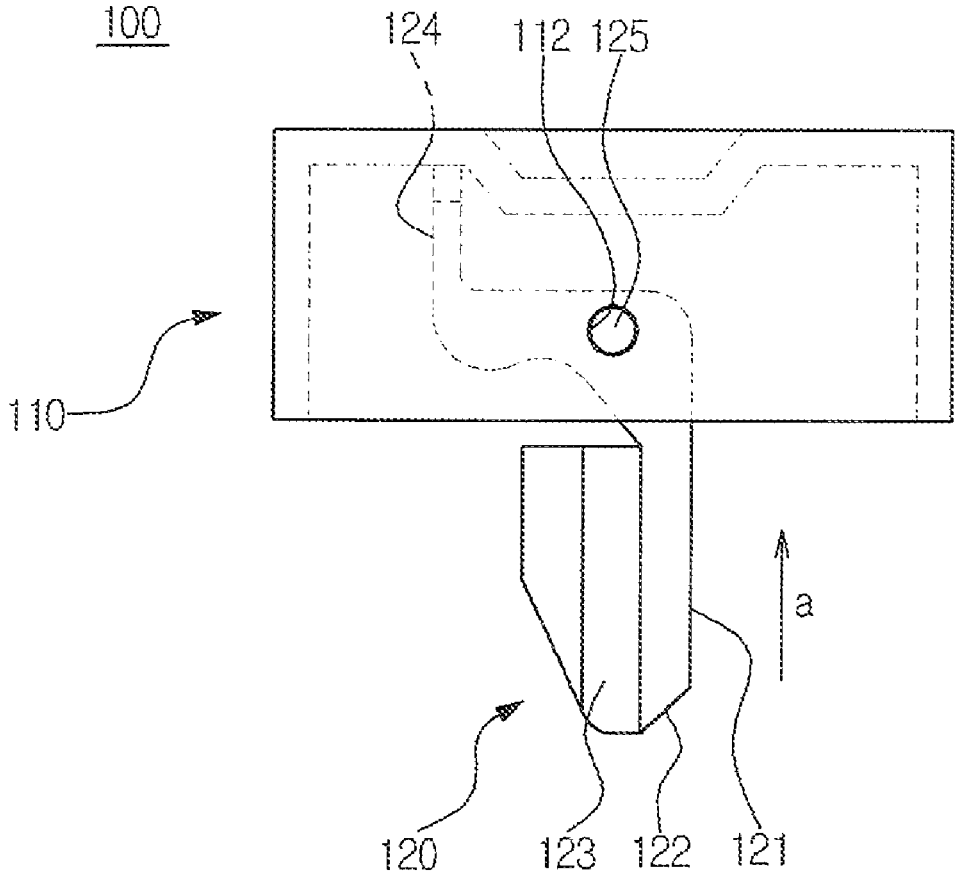

FIG. 2 is a perspective view illustrating the paper supply unit in accordance with an embodiment of the present disclosure. FIG. 3 is a perspective view illustrating a vertical feed device in accordance with an embodiment of the present disclosure. FIG. 4 is a perspective view illustrating a horizontal feed device in accordance with an embodiment of the present disclosure. FIGS. 5A and 5B are views illustrating a guide device in accordance with an embodiment of the present disclosure.

As shown in FIGS. 1 and 2, the paper supply unit 4 can include the cassette 20, a vertical feed device 30, a horizontal feed device 50, and a guide device 100.

The main body 10 of the printing device 3 has an opening 13 through which the cassette 20 can slide into and out of the printing device 3. In this embodiment, the paper supply unit 4 can be disposed in the main body 10 of the printing device 2. The paper supply unit 4 can have a separate main body, that is, the paper supply unit 4 can have its own case. Furthermore, the case of the paper supply unit 4 can be made to be separate from the main body 10 of the printing device 3 or can be integrated with the main body 10 of the printing device 3.

The cassette 20 can include a first holding portion 21 and a second holding portion 25, each configured to accommodate papers. The cassette 20 can be selectively attached to or detached from the main body 10 through the opening 13 in the main body 10 along a direction b.

Papers loaded in the first holding portion 21 can be supported or held in place by guide plates 22 and 23. The guide plate 22 may be disposed in the front or forward portion of the first holding portion 21. The guide plate 23 may be disposed in the back or rear portion of the first holding portion 21. Papers loaded in the first holding portion 21 can also be supported or held in place by a guide plate 24 disposed at one side of the cassette 20 (see FIG. 1). Furthermore, papers loaded in the second holding portion 25 can be supported or held in place by guide plates 26 and 27 and by a moving member 51. The guide plate 26 may be disposed in the front or forward portion of the second holding portion 25. The guide plate 27 may be disposed in a back or rear portion of the second holding portion 25. The moving member 51 may be disposed at one side of the cassette 20 opposite from guide plate 24.

According to an embodiment, when the papers in the first holding portion 21 are exhausted or depleted, papers loaded in the second holding portion 25 can be transferred to the first holding portion 21 by the horizontal feed device 50. Such transfer of papers is described in more detail below.

As shown in FIG. 3, the vertical feed device 30 of the paper supply unit 4 can include an elevating plate 31 disposed at the bottom of the first holding portion 21 to support the papers loaded in the first holding portion 21 and a vertical feed driving unit 32 disposed at a front end and a back end of the first holding portion 21. The vertical feed driving unit 32 may be configured to raise or lower the elevating plate 31.

The vertical feed driving unit 32 can include a first driving unit 33 at one end (e.g., front end) of the first paper holding porting 21 and a second driving unit 37 at the other end (e.g., back end) of the first holding portion 21. The first driving unit 33 and the second driving unit 37 may include driving pulleys 34 and 38, respectively, and driven pulleys 35 and 39, respectively. The driving pulley 34 and the driven pulley 35 can be connected to each other by a timing belt 36, while the driving pulley 34 and the driven pulley 39 can be connected to each other by a timing belt 40. Each of a front end and a back end of the elevating plate 31 can be fixed or attached to the timing belts 36 and 40, respectively, by fixing members 43 (see expanded portion in FIG. 3). Furthermore, the driving pulley 34 of the first driving unit 33 and the driving pulley 38 of the second driving unit 34 can be connected to each other by a first shaft 41 disposed below the elevating plate 31. A driving gear 42 configured to transfer a driving force generated by an elevation driving motor (not shown) to the first shaft 41 may be disposed at one end of the first shaft 41. In one embodiment, the elevation driving motor can be disposed in the main body of the printing device 3, and the elevation driving motor and the driving gear 42 can be selectively connected to each other by a coupling device (not shown) when the cassette 20 is mounted in the main body 10.

The driving force generated by the elevation driving motor can be transferred to the driving pulley 34 of the first driving unit 33 and to the driving pulley 38 of the second driving unit 37 through the first shaft 41 such that timing belts 36 and 40 can rotate at the same linear velocity to move vertically (e.g., raise or lower) the elevation plate 31.

The components associated with reference numerals 45 and 46 in FIG. 3 are driving unit plates disposed at both ends of the elevation plate 31, and are configured to guide the vertical movement of the elevation plate 31. The pulleys 34 and 35, and 38 and 39 are rotatably coupled to the driving unit plates 45 and 46, respectively.

As shown in FIG. 4, the horizontal feed device 50 can include the moving member 51 disposed at one side of the second holding portion 25, and can be configured to push or move papers loaded on a bottom plate 28 of the second holding portion 25 to the first holding portion 21. The horizontal feed device 50 can include a horizontal feed driving unit 52 configured to drive the moving member 51.

The horizontal feed driving unit 52 can include a second driving motor (not shown) disposed in the main body 10 of the printing device 3, a driving pulley 53 configured to be coupled to the second driving motor when the cassette 20 is mounted in the main body 10, a timing belt 55 disposed such that one end is supported by the driving pulley 53 and the other end supported by a driven pulley 54, and a stationary member 56 configured to connect the timing belt 55 and the moving member 51.

A driving force generated by the second driving motor can be transferred to the driving pulley 53 of the horizontal feed device 50 to rotate the timing belt 55 of the horizontal feed device 50. Because the moving member 51 is attached to one side of the timing belt 55, the moving member 51 can be moved in the direction of the first holding portion 21 (i.e., forward direction) or away from the first holding portion 21 (i.e., backward direction) based on the direction in which the driving pulley 53 rotates.

As shown in FIGS. 1, 5A, and 5B, the guide device 100 can be disposed between the first holding portion 21 and the second holding portion 25 when the cassette 20 is mounted in the main body 10. The guide device 100 can be configured to guide the paper loaded in the first holding portion 21. According to an embodiment, the paper supply unit 4 is configured such that an end of at least one paper in the upper portion of a stack of papers loaded in the first holding portion 21 is supported or abuts the guide device 100, and thus the papers loaded in the first holding portion 21 can be guided to a pickup roller 11 while the alignment of the papers is maintained.

The guide device 100 can include a guide holder 10 configured to be fixed to the main body 10 of the printing device 3, and a guide 120 configured to be hinged to the guide holder 110. The reference numeral 112 represents a shaft hole in the guide holder 110 into which a hinge shaft 125 of the guide 120 can be inserted.

The guide holder 110 can be fixed or attached to an upper frame 12 (see FIG. 1) of the main body 10 and the position of the guide holder 110 can vary according to the size of papers loaded in the first holding portion 21.

The guide 120 can include a first guide portion 121, a second guide portion 122, a third guide portion 123, and a support portion 124.

The first guide portion 121 can be positioned on the side of the paper loaded in the first holding portion 21 that is opposite the position of the pickup roller 11 in the main body 10 when the cassette 20 is mounted in the main body 10 (see FIG. 1).

The first guide portion 121 can be configured to support or abut the back end of papers loaded in the first holding portion 21 when the cassette 20 is mounted in the main body 10 such that the papers in the first holding portion 121 can be guided to the pickup roller 11 while maintaining the alignment of the papers. For example, when an external impact or vibration is transmitted to the paper supply unit 4, the first guide portion 121 maintains the alignment of papers to be picked up by the pickup roller 11 to prevent any possible paper jamming that may otherwise occur.

The second guide portion 122 can be configured to extend from the lower portion of the first guide portion 121. The second guide portion 122 can have an angled or inclined surface (see FIG. 5B) such that, for example, the lower portion of the second guide portion 122 is farther away from the pickup roller 11 than the upper portion of the second guide portion 122. When some of the papers loaded in the first holding portion 21 are not properly aligned, these papers can be re-aligned by coming in contact with the angled surface of the second guide portion 122 as the papers rise in the first holding portion 21, and may thus still be properly aligned when reaching the top of the first guide portion 121.

The third guide portion 123 can be configured to extend from one side of the first guide portion 121. The third guide portion 123 may extend from the first guide portion 121 in the direction of the opening 13 of the main body 10. The third guide portion 123 may be angled or inclined away from the pickup roller 11. When the cassette 20 is being mounted in the main body 10 of the printing device 3, the third guide portion 123 can guide the papers loaded in the first holding portion 21 to prevent the side of the papers in the cassette-mounting direction from being caught by the guide 120, and thus from being jammed.

The support portion 124 can be configured to prevent the guide 120, once it is positioned in a guide state, from being rotated in a direction opposite from the pickup roller 11. The support portion 124 can be configured to extend upwardly from the upper end of the guide 120 toward the guide holder 110 when the guide 120 is in the guide state, and can be supported or held in place by the lower surface of the guide holder 110. According to an embodiment, the guide state can correspond to a state in which the first guide portion 121 of the guide 120 is parallel to the ascending direction a of the papers loaded in the first holding portion 21, as shown in FIGS. 1 and 5B.

FIGS. 6A to 6D are views illustrating the operation of the paper supply unit in accordance with an embodiment of the present disclosure.

Figure 6A:
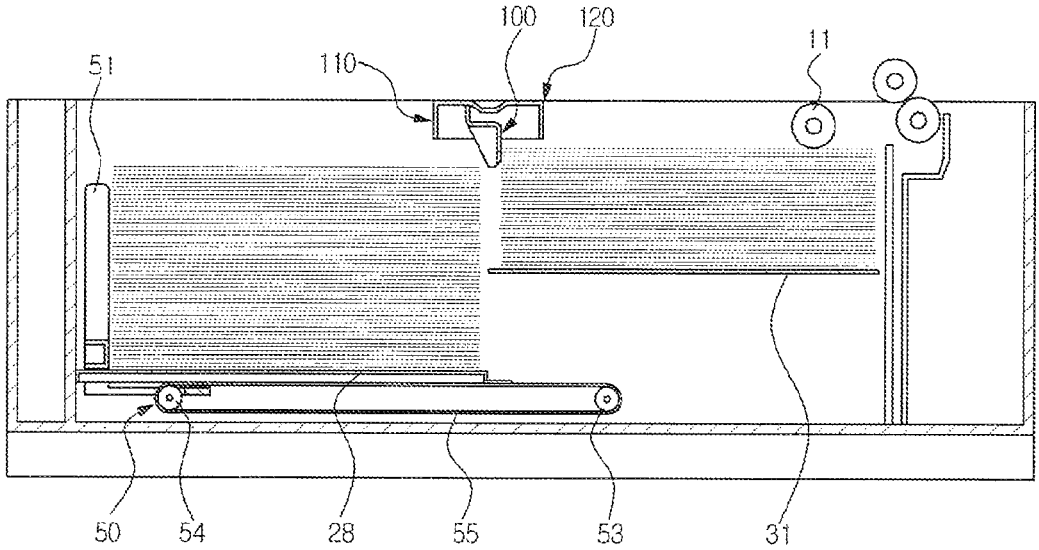
FIGS. 6A to 6D are views illustrating the operation of the paper supply unit in accordance with an embodiment of the present disclosure.

As shown in FIG. 6A, papers loaded in the first holding portion 21 can be raised up to the pickup roller 11 by the vertical feed device 30 such that the uppermost paper of the stack of papers in the first holding portion 21 is picked up by the pickup roller 11. The picked up paper is fed up to the printing device 3, in which the developing unit 6, the transfer unit 7, and the fusing unit 8 are located. Because the papers in the first holding portion 21 that are next to the pickup roller 11 are supported by the first guide portion 121 of the guide 120, the alignment of such papers can be maintained even when an external impact or vibration is applied to the paper supply unit 4 or when the paper supply unit 4 is inclined.

Figure 6B:
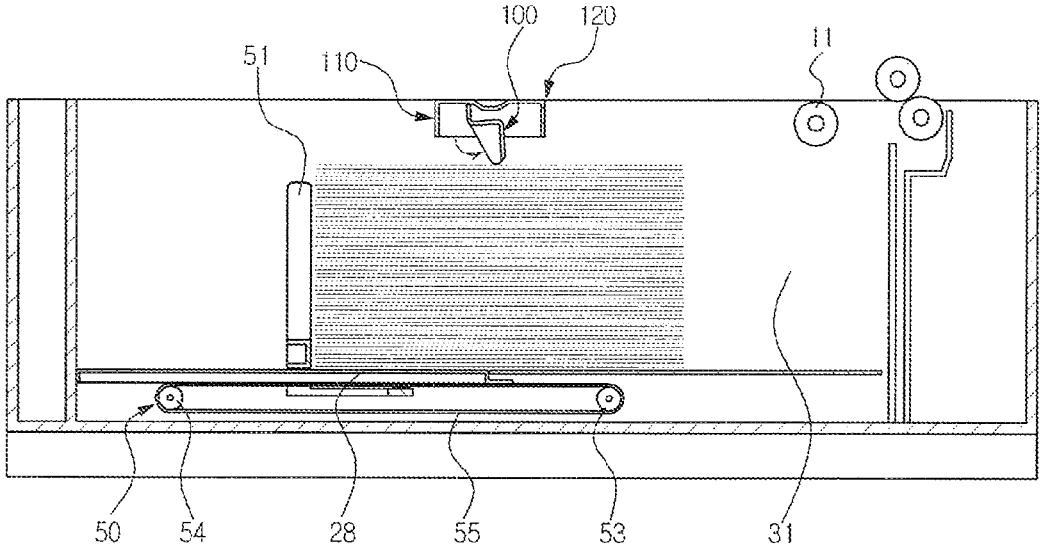

As shown in FIG. 6B, when the papers loaded in the first holding portion 21 have been exhausted or depleted, a sensor (not shown) can sense or detect that the first holding portion 21 is empty, and can transmit a corresponding signal to a control unit (not shown). The control unit can transmit driving instructions to the second driving motor of the horizontal feed device 50 to start moving the moving member 51 toward the first holding portion 21. Thereby, papers loaded in the second holding portion 25 can be fed or transferred to the elevation plate 31 of the first holding portion 21. The guide 120 of the guide device 100 may interfere with the papers in the second holding portion 25 depending upon the amount of the papers loaded in the second holding portion 25. According to an embodiment, however, because the guide 120 can rotate counterclockwise as shown in FIG. 6B, the guide 120 may not prevent the papers loaded in the second holding portion 25 moving toward the first holding portion 21. After the papers pass through the guide 120, the guide 120 can return to its initial state (e.g., the state of the guide shown in FIG. 1) by rotating clockwise, e.g., as a result of its own weight.

Figure 6C:
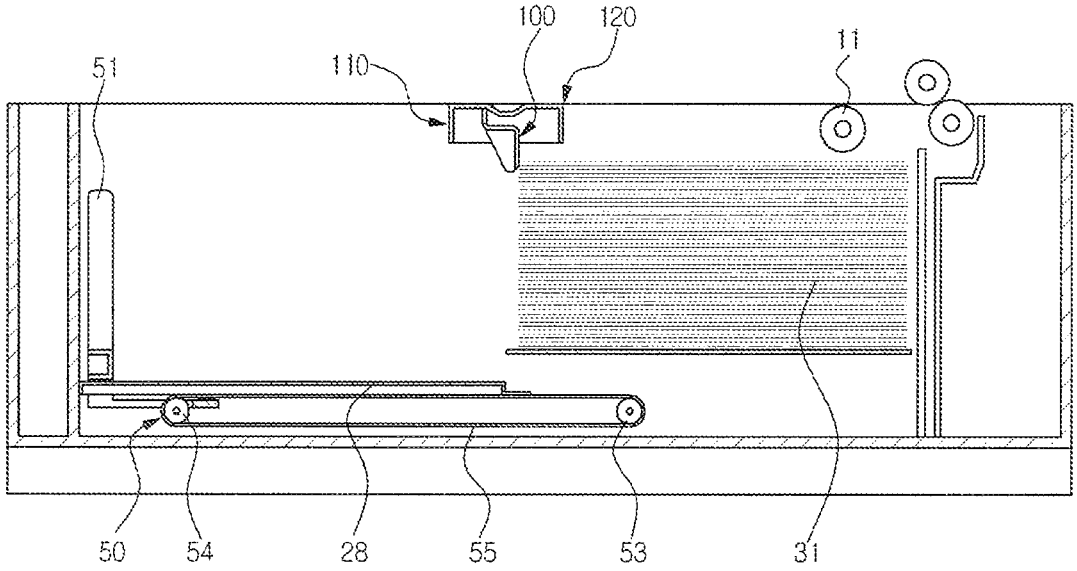

As shown in FIG. 6C, the papers fed to the first holding portion 21 are raised by the vertical feed device 30 until the uppermost paper contacts the pickup roller 11.

Figure 6D:
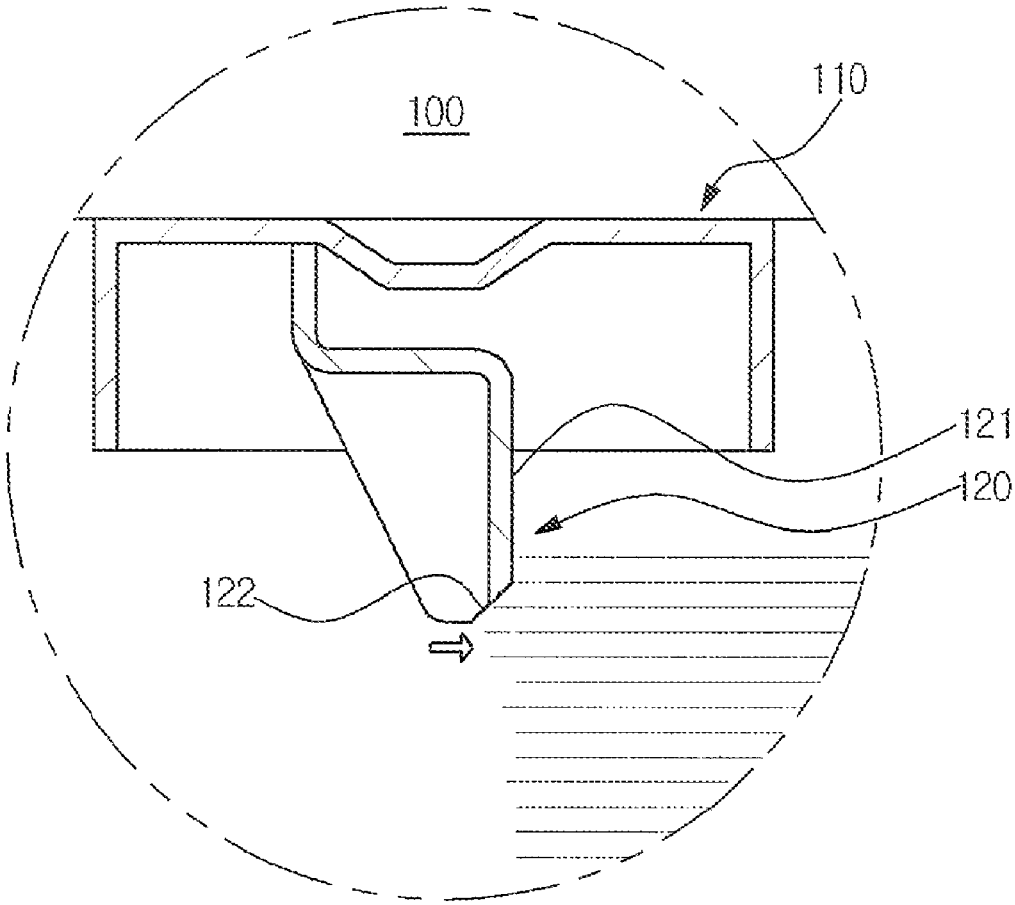

As shown in FIG. 6D, while some of the papers among the papers raised by the vertical feed device 30 can be slightly offset or misaligned in the vertical feed device 30 in the direction of the second holding portion 25 (see the arrow in FIG. 6D), those papers can be realigned by the second guide portion 122 of the guide 120.

It should be understood that the several of the present disclosure above described can be variously modified. For example, few additional embodiments of the present disclosure, by way of examples of such variations will be described below. For brevity sake, some parts in these embodiments, which are substantially the same as those in previously described embodiments, are denoted by the same reference numerals as detailed description thereof being unnecessary to be repeated.

Figure 7:
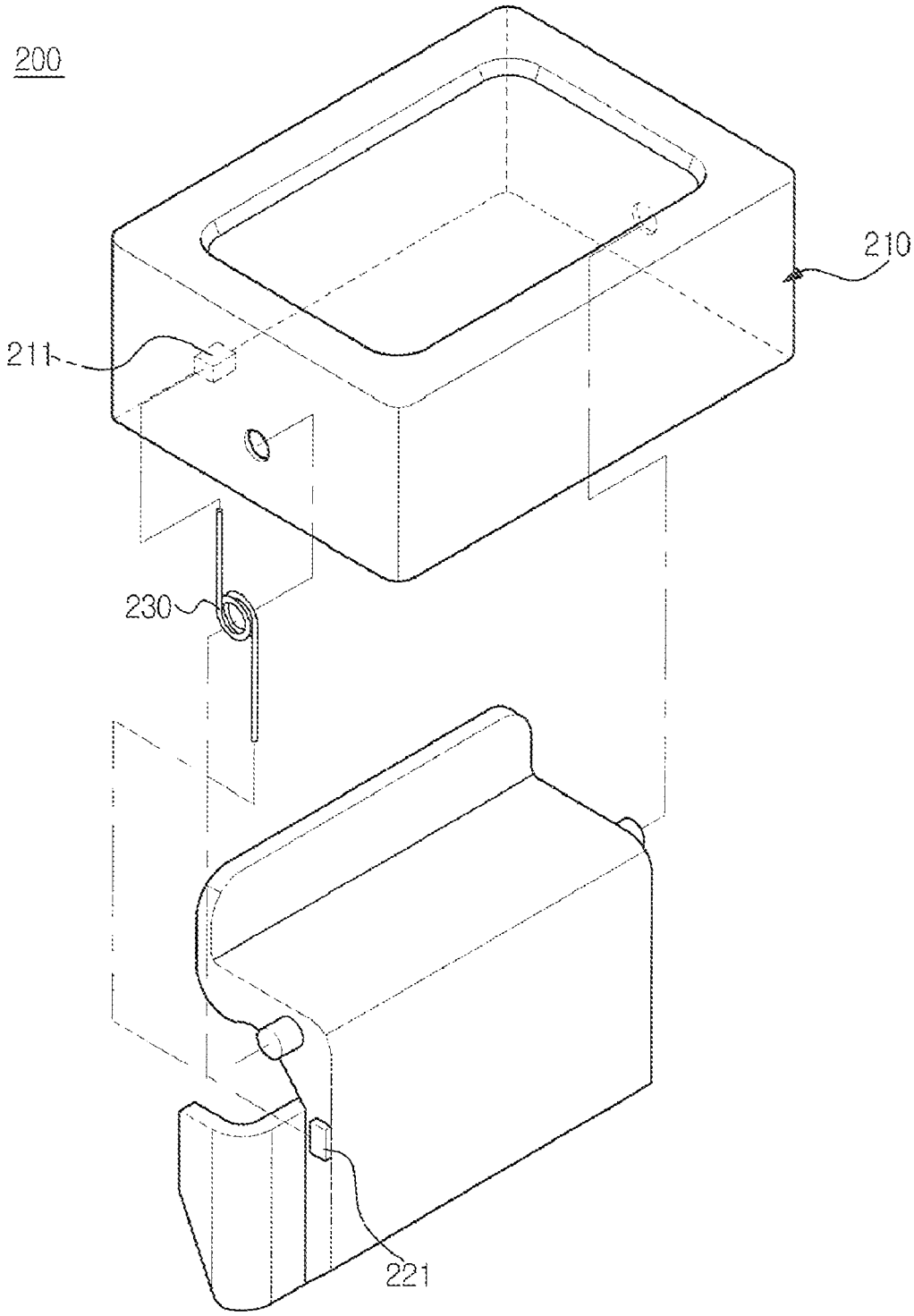
FIG. 7 is a perspective view illustrating a guide device in accordance with another embodiment of the present disclosure.

FIG. 7 is a perspective view illustrating a guide device in accordance with another embodiment of the present disclosure.

A guide device 200 of this embodiment further includes a torsion spring 230 disposed with one end supported by an end 211 of a guide holder 210 and the other end supported by an end 221 of a guide 220. The torsion spring 230 is configured to improve the returning motion of the guide 220.

Figure 8A:
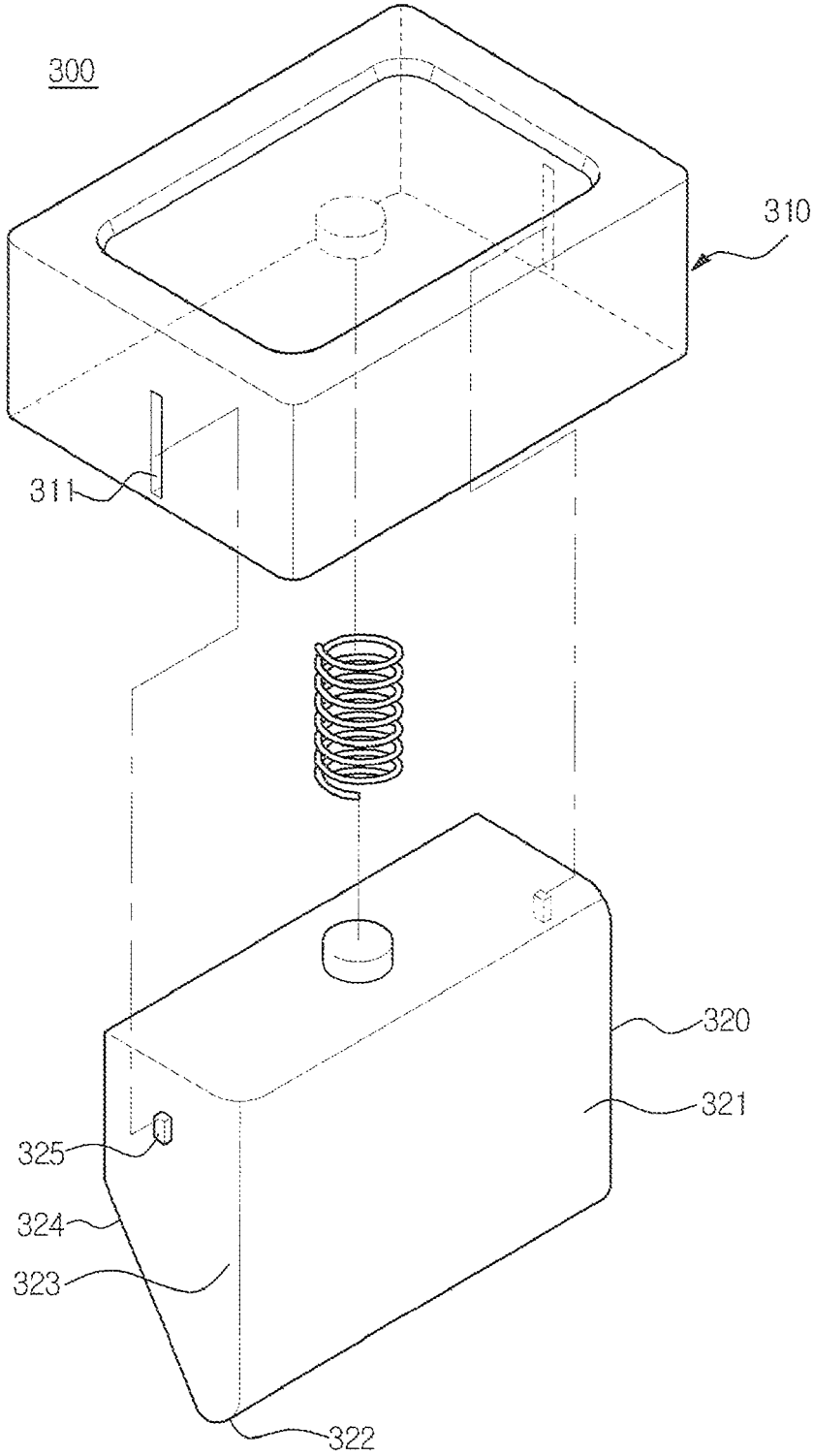
FIG. 8A is perspective views illustrating a guide device in accordance with yet another embodiment of the present invention.
Figure 8B:
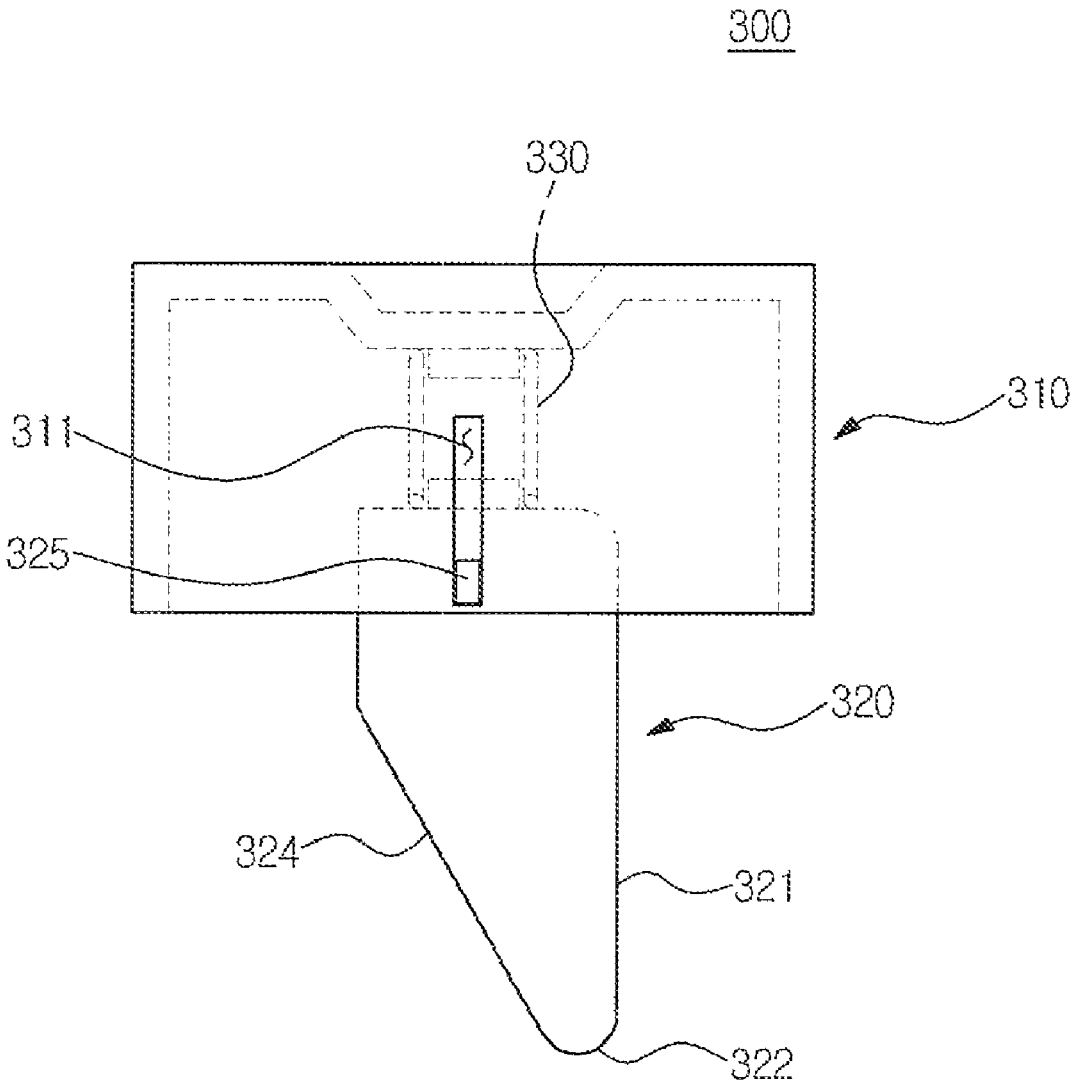
FIG. 8B is a sectional view illustrating of the guide device of FIG. 8A.

FIG. 8A is a perspective view illustrating a guide device in accordance with yet another embodiment of the present disclosure. FIG. 8B is a partial sectional view of the guide device shown in FIG. 8A.

According to the embodiment shown in FIGS. 8A and 8B, a guide device 300 can include a guide holder 310 and a guide 320 connected to the guide holder 310 such that the guide 320 can slide vertically.

Sliding holes 311 that guide sliding protrusions 325 of the guide 320, which are respectively inserted into the sliding holes 311, may be formed on opposite sides of the guide holder 310.

The guide 320 includes a first guide portion 321 configured to guide the papers loaded in the first holding portion 21 as the papers are raised by the vertical feed device 30 toward the pickup roller 11. The guide 320 may also include a second guide portion 322 configured to guide the papers in the first holding portion 21 that may become offset or misaligned while being raised by the vertical feed device 30. The guide 320 may also include a third guide portion 323 configured to guide the misaligned papers to the first holding portion 21 during the process of mounting the cassette 20. The first guide portion 321, the second guide portion 322, and the third guide portion 323 according to these embodiments may have substantially the same functions as those of the first guide portion 121, the second guide portion 122, and the third guide portion 123 of the previously described embodiments.

According to an embodiment, the guide 320 can further include an interference portion 324 disposed opposite to the first guide portion 321. The interference portion 324 can have an angled or inclined surface such that the lower portion of the interference portion 324 is closer to the pickup roller 11 than the upper portion of the interference portion 324. With such configuration, when the papers that are fed or transferred from the second holding portion 25 to the first holding portion 21 come in contact with the interference portion 324, the guide 320 can slide upwardly such that the papers can be fed to the first holding portion 21.

Reference numeral 330 represents a coil spring configured to elastically bias the guide 320 downward (see FIG. 8B).

While in the above-described embodiments of the paper supply unit of the image forming apparatus, it is described that three cassettes, one of which being a high capacity cassette (see FIG. 1), the number of cassettes and their capacity need not be so limited, and the paper supply unit may include any number of the cassettes of any capacity.

Furthermore, while in the above-described embodiments of paper supply unit, implementation of one guide device is described, the paper supply unit can be configured to include two or more guide devices.

Although various embodiments have been shown and described, it would be appreciated by those skilled in the art that changes may be made in these embodiments without departing from the principles and spirit of the disclosure, the scope of which is defined in the claims and their equivalents.

What is claimed is:

1. A printing medium supply unit, comprising:

a main body having an opening;

a cassette configured to be removably disposed in the main body through the opening, the cassette including a first holding portion and a second holding portion each configured to hold printing medium, the cassette being configured to transfer printing medium from the second holding portion to the first holding portion; and a guide device disposed between the first holding portion and the second holding portion of the cassette and disposed above the cassette, the guide device being configured to guide the printing medium held in the first holding portion.

2. The paper supply unit according to claim 1, wherein the guide device is configured to guide an end of the printing medium in an upper portion of a stack of printing medium loaded in the first holding portion.

3. The paper supply unit according to claim 1, wherein the guide device includes a guide holder coupled to the main body and a guide coupled to the guide holder.

4. The paper supply unit according to claim 3, wherein:

the guide of the guide device includes a first guide portion positioned opposite a pickup roller disposed in the main body; and the first guide portion is configured to support an end of the printing medium in an upper portion of a stack of printing medium loaded in the first holding portion when the cassette is mounted in the main body.

5. The paper supply unit according to claim 4, wherein:

the guide of the guide device further includes a second guide portion configured to extend from a lower portion of the first guide portion, and the second guide portion has an inclined surface such that a lower portion of the inclined surface is farther away from the pickup roller than an upper portion of the inclined surface.

6. The paper supply unit according to claim 4, wherein:

the guide of the guide device further includes a third guide portion configured to extend from a side of the first guide portion in a direction of the opening of the main body, the third guide portion being inclined away from the pickup roller.

7. The paper supply unit according to claim 3, wherein the guide of the guide device is rotatably coupled to the guide holder.

8. The paper supply unit according to claim 7, wherein the guide of the guide device is configured to rotate in a direction away from a pickup roller disposed in the main body is restricted.

9. The paper supply unit according to claim 3, wherein the guide device further includes an elastic member configured to elastically bias the guide of the guide device.

10. The paper supply unit according to claim 3, wherein the guide of the guide device is vertically slidably coupled to the guide holder.

11. The paper supply unit according to claim 10, wherein:

the guide of the guide device includes an interference portion, and the guide of the guide device is configured to slide vertically when contact occurs between the interference portion and printing medium being fed from the second holding portion to the first holding portion.

12. The paper supply unit according to claim 11, wherein the guide device further includes an elastic member to elastically bias the guide of the guide device downward.

13. The paper supply unit according to claim 1, further comprising:

a vertical feed device configured to raise and lower the printing medium in the first holding portion, wherein the guide device is configured to guide the printing medium being raised by the vertical feed device.

14. The paper supply unit according to claim 1, wherein the guide device is a first guide device, the paper supply unit further comprising:

a second guide device coupled to the main body and disposed between the first holding portion and the second holding portion.

15. A printing medium supply unit usable in an image forming apparatus for holding a supply of printing media, comprising:

a printing media holder including a first holding portion and a second holding portion each configured to hold thereon printing medium, the printing media holder being configured to transfer printing medium from the second holding portion to the first holding portion; and a guide device disposed between the first holding portion and the second holding portion of the printing media holder and disposed above the printing media holder, the guide device including a movable guide member that is configured to move in a first direction to align printing medium held in the first holding portion, the movable guide member being configured to move in a second opposite the first direction to allow printing medium to be transferred from the second holding portion to the first holding portion.

16. The printing medium supply unit according to claim 15, wherein the movable guide member is configured to rotate in each of the first and second directions.

17. The printing medium supply unit according to claim 15, wherein the movable guide member is configured to vertically slide in each of the first and second directions.

18. The printing medium supply unit according to claim 15, wherein the guide device further comprises:

an elastic member configured to elastically bias the moveable guide member toward the first direction.

19. The printing medium supply unit according to claim 15, further comprising:

a vertical feed device including an elevating plate configured to move in a vertical direction to raise printing medium held in the first holding portion upward; and a horizontal feed device including a moveable member configured to move in a lateral direction to transfer printing medium held in the second holding portion to the first holding portion.

20. An image forming apparatus, comprising:

a printing unit configured to form a visible image on a printing medium;

a printing media holder detachably mounted in the image forming apparatus, the printing media holder including a first holding portion and a second holding portion each configured to hold thereon one or more printing media, the printing media holder being configured to transfer a replenish supply of printing media from the second holding portion to the first holding portion;

a pickup roller disposed proximate to the first holding portion, the pickup roller being configured to pickup the printing medium from one or more printing media held in the first holding portion, and to convey the printing medium to the printing unit; and a guide device disposed between the first holding portion and the second holding portion of the printing media holder and disposed above the print media holder, the guide device including a movable guide member that is configured to move in a first direction to align one or more printing media held in the first holding portion, the movable guide member being configured to move in a second opposite the first direction to allow the replenish supply of printing media to be transferred from the second holding portion to the first holding portion.

* * * * *

UNITED STATES PATENT AND TRADEMARK OFFICE

CERTIFICATE OF CORRECTION

PATENT NO. : 8,267,395 B2
APPLICATION NO. : 12/511649
DATED : September 18, 2012
INVENTOR(S) : Myung Woo Yang It is certified that error appears in the above-identified patent and that said Letters Patent is hereby corrected as shown below:

Title Page, Item (56) (Other Publications); Line 1; Delete "langauge" and insert -- language --, therefor.
Title Page, Item (56) (Other Publications); Line 3; Delete "langauge" and insert -- language --, therefor.

Signed and Sealed this
Seventh Day of May, 2013

Teresa Stanek Rea
*Acting Director of the United States Patent and Trademark Office*